US005232220A

United States Patent [19]

Poschenrieder

[11] Patent Number: 5,232,220

[45] Date of Patent: Aug. 3, 1993

[54] BALL GAME RACKET, ESPECIALLY FOR TENNIS OR SQUASH RACKET

[75] Inventor: Martin Poschenrieder, Langquaid, Fed. Rep. of Germany

[73] Assignee: Gunter Adam, Fed. Rep. of Germany

[21] Appl. No.: 712,663

[22] Filed: Jun. 10, 1991

Related U.S. Application Data

[63] Continuation-in-part of Ser. No. 416,783, Oct. 4, 1989, abandoned.

[51] Int. Cl.[5] ..... A63D 49/02

[52] U.S. Cl. ..... 273/73 C; 273/73 D

[58] Field of Search ..... 273/73 R, 73 C, 73 D, 273/73 E, 73 F, 73 G

[56] References Cited

U.S. PATENT DOCUMENTS

| | | | |
|---|---|---|---|
| 3,528,658 | 9/1970 | Cheris et al. | 273/73 C |
| 3,545,756 | 12/1970 | Nash | 273/73 D |
| 3,901,507 | 8/1975 | Santini-Ormieres et al. | 273/73 D |
| 3,998,457 | 12/1976 | Dempsey et al. | 273/73 C |
| 4,836,543 | 6/1989 | Holzer | 273/73 C |
| 5,131,653 | 7/1992 | Yu | 273/73 R |

FOREIGN PATENT DOCUMENTS

| | | | |
|---|---|---|---|
| 1043897 | 11/1958 | Fed. Rep. of Germany | 273/73 D |
| 1089675 | 9/1960 | Fed. Rep. of Germany | 273/73 C |
| 2270908 | 12/1975 | France | 273/73 C |
| 2150444 | 7/1985 | United Kingdom | 273/73 R |

*Primary Examiner*—V. Millins
*Assistant Examiner*—William E. Stoll
*Attorney, Agent, or Firm*—Hoffman, Wasson & Gitler

[57] ABSTRACT

Ball game racket, especially tennis racket or squash racket has a frame made of plastics, which in the plane of stringing provided on the head is designed in two parts and whose halves exhibit a trough-shaped cross section profile—open toward central plane (M)—with a concave wall, whose two longitudinal sides, bordering the open side of the cross section profile, are adjacent to central plane (M). The halves are connected to one another by connecting pins, formed on the respective wall, as well as sleeve-like sections receiving them. The connecting pins and sleeve-like sections each merge directly into the wall in the area of longitudinal sides or alternately to this the frame halves, at least on some connecting pins provided on the head and/or sleeve-like sections, exhibit a distance from one another, and the strings forming the stringing are run around these connecting pins or sleeve-like sections.

15 Claims, 6 Drawing Sheets

BALL GAME RACKET, ESPECIALLY FOR TENNIS OR SQUASH RACKET

This application is a continuation-in-part of Ser. No. 07/416,783, filed Oct. 4, 1989, now abandoned.

FIELD OF THE INVENTION

The invention relates to a ball game racket, which is especially intended for use as a tennis racket or squash racket.

BACKGROUND OF THE INVENTION

A badmintion racket made from plastic is known (DE-PS 10 43 897), whose frame consists of two halves. The halves are connected by connecting pins, and sleeve-like sockets which form connecting openings for receiving the pins. A grid-like element, made of plastic, which forms the "stringing" of this badminton racket, is received between the halves.

The constructive design used in this badminton racket cannot be used in tennis rackets, squash rackets or similar rackets. While the grid-like striking part, formed as one piece, contributes substantially to the stability of the badminton racket, such grid-like striking part cannot be used as stringing in so-called quality tennis rackets, squash rackets or similar ball game rackets. Further, in the badminton racket the weight of the grid-like striking part is relatively large in comparison with balls usually used in badminton games. As such, the stress on the frame during play is relatively small. The use of a tennis racket, squash racket or similar ball racket present substantially different problems. Specifically, substantially greater forces and high torsion forces occur in the head and frame. These forces are caused by the oval shape of the head. In addition, the stringing experiences constant changing during play. Consequently, the dynamic stress and the resulting great forces certainly must be transmitted to the frame.

SUMMARY OF THE INVENTION

The object of the invention is to provide a tennis racket, squash racket or similar ball game racket, whose two-part design can be made simply and at a reasonable cost, but at the same time meets the requirements of a tennis racket, squash racket or similar ball game racket with regard to strength and carrying capacity. More specifically, the instant invention is directed to a ball game racket with a frame made from plastic, which is formed in two parts along the plane of the stringing provided on the head. The halves exhibit a channel-like cross section profile, open toward the center plane, with a concave wall. The walls have two longitudinal sides bordering the open side of the cross section profile adjacent to the center plane. These halves are connected to one another by connecting pins formed on the respective wall as well as sleeve-like sections receiving the pins.

To achieve this object, a ball game racket has been designed so that the frame halves exhibit a distance from one another at least on some connecting pins and/or sleeve-like sections provided on the head. The strings forming the stringing, are then led around these connecting pins or sleeve-like sections. Further, the connecting pins and sleeve-like sections may be designed to respectively merge directly into the wall in the area of the longitudinal sides.

In an embodiment of the invention, the strings forming the stringing on the head of the two-part ball game racket are fastened on the connecting pins or sleeve-like sections. This design has the advantage that the forces acting on the stringing when the tennis racket is used are directly transmitted to the connecting areas between the two frame halves on the head or frame of the tennis racket. This force transmission takes place where it is optimal a the static and dynamic viewpoint, so that particularly favorable conditions result.

In another preferred embodiment of the ball game racket according to the invention, the connecting pins and the sleeve-like sections forming the connection openings for the pins merge directly into the wall forming the cross section profile along the edges of the walls. The two frame halves are then directly connected to one another along their open cross section sides. As a result, not only are the two frame halves effective as elements for receiving stresses or forces, but the cross section profiles of the two frame halves in the end form a hollow body which receives stresses and forces. In its final form, not only are the wall which forms the cross section profile connected to one another by the connecting pins and/or the sleeve-like sections, but the two cross section profiles are connected along edges of the walls. Therefore, when put under stress, the walls forming the cross section profiles cannot be turned aside or bent in or out in the area of the edges.

Developments of the invention are the object of the subclaims.

BRIEF DESCRIPTION OF THE DRAWINGS

The invention is explained in greater detail below with reference to the following figures.

DETAILED DESCRIPTION OF THE INVENTION

Figure 1:
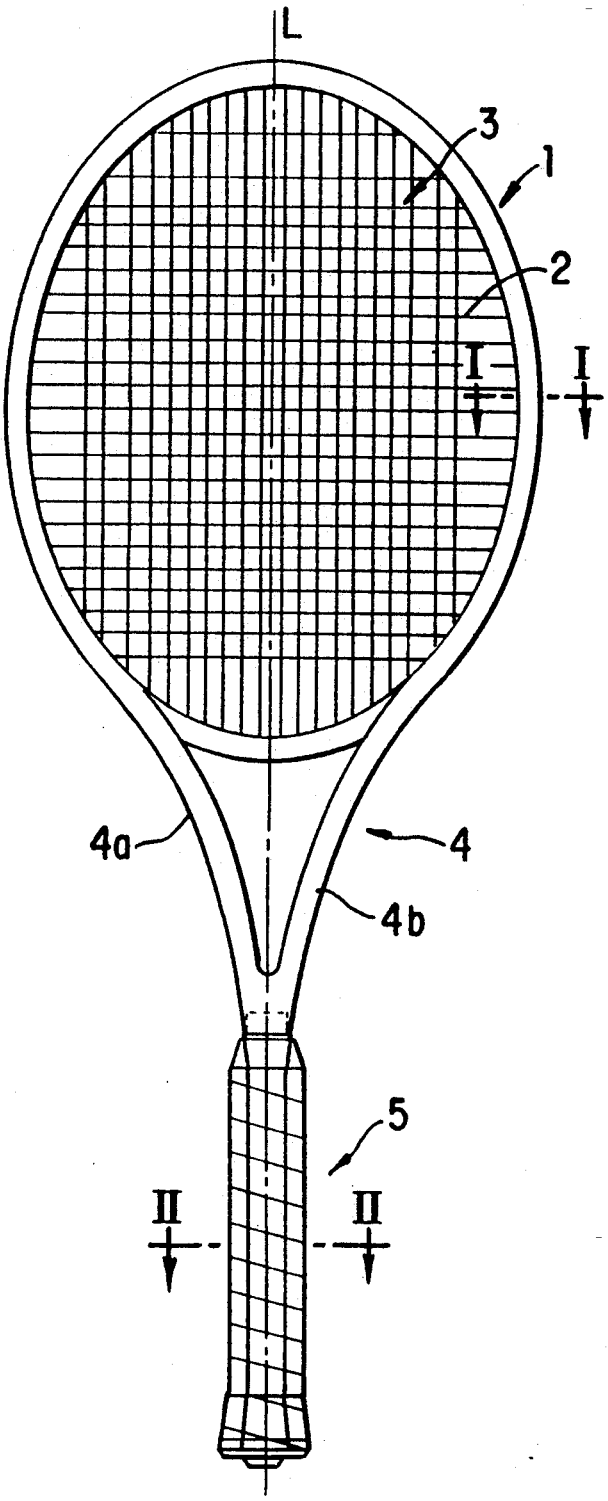
FIG. 1 shows a view of a tennis racket according to the invention.
Figure 2:
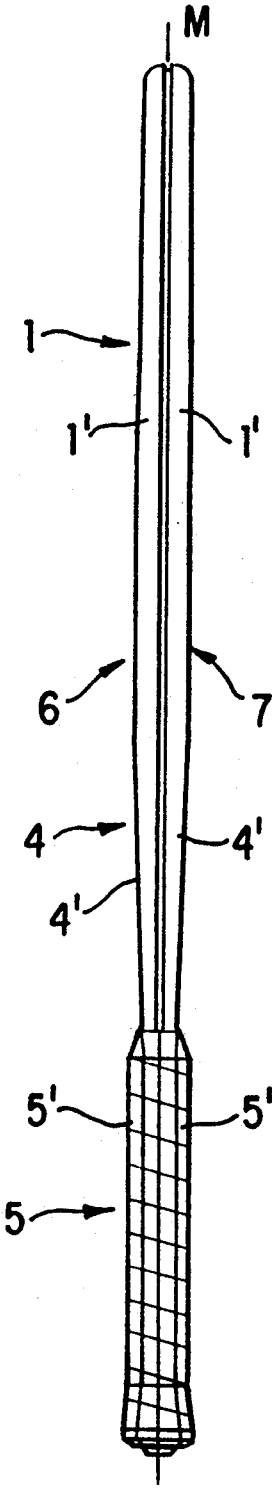
FIG. 2 shows a side view of the tennis racket depicted in FIG. 1.
Figure 3:
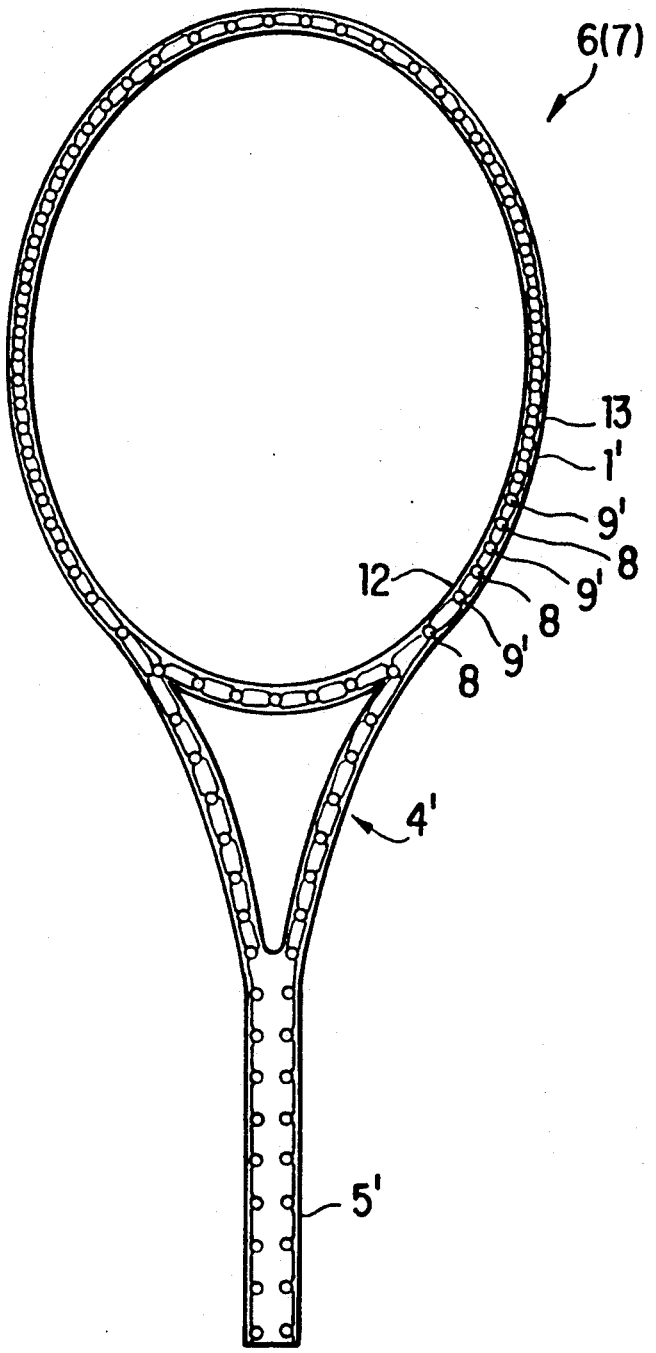
FIG. 3 shows a view of one of the two frame halves.
Figure 4:
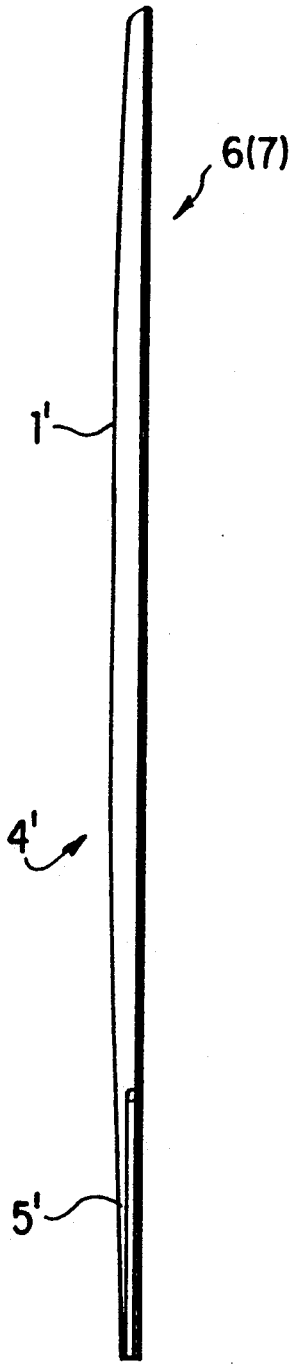
FIG. 4 shows a side view of the tennis racket depicted in FIG. 3.

The frame of the tennis racket represented in the figures consists of a head 1 for stringing 3 formed by strings 2 as well as handle 5, which is connected to head 1 by throat 4 formed by the two arms **4*a* and 4*b*. The frame, formed by head 1, throat 4 and handle 5, is composed of two frame halves 6 and 7. The frame halves 6 and 7 are produced from plastic reinforced by carbon fibers by molding under pressure. These halves 6, 7 are connected to each other to form the frame on both sides of a center plane M enclosing stringing 3. The halves 6,7 are each produced with a head half 1', a throat half 4', as well as a handle half 5'. In all of these areas, the two frame halves 6, 7** are substantially dish-shaped along their cross sections. In completed condition, i.e., with halves 6, 7 connected to one another, the tennis racket forms an outwardly closed hollow body in the area of the head 1, throat 4 and handle 5. In this way, the smallest possible weight for the tennis racket is obtained without sacrificing stability or strength.

To fasten the two frame halves 6, 7 together, on each of them there is provided a multiplicity of connecting pins 8, which are designed as hollow pins. Connecting openings are also provided which correspond to the connecting pins 8. The openings are each formed by a partial section 9' of an opening 9 of a sleeve-like section 10.

Figure 5:
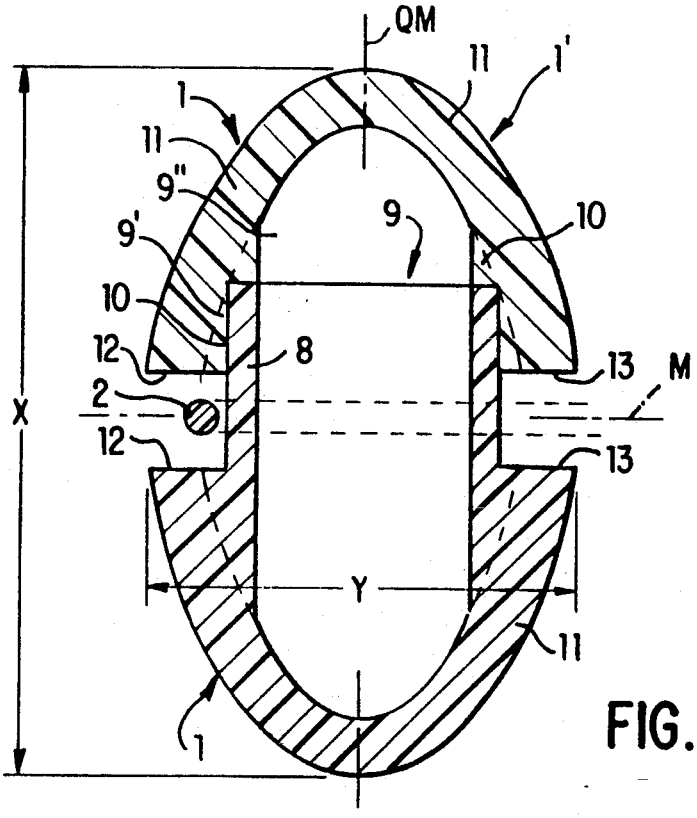
FIG. 5 shows a section corresponding to line I—I of through the head.
Figure 7:
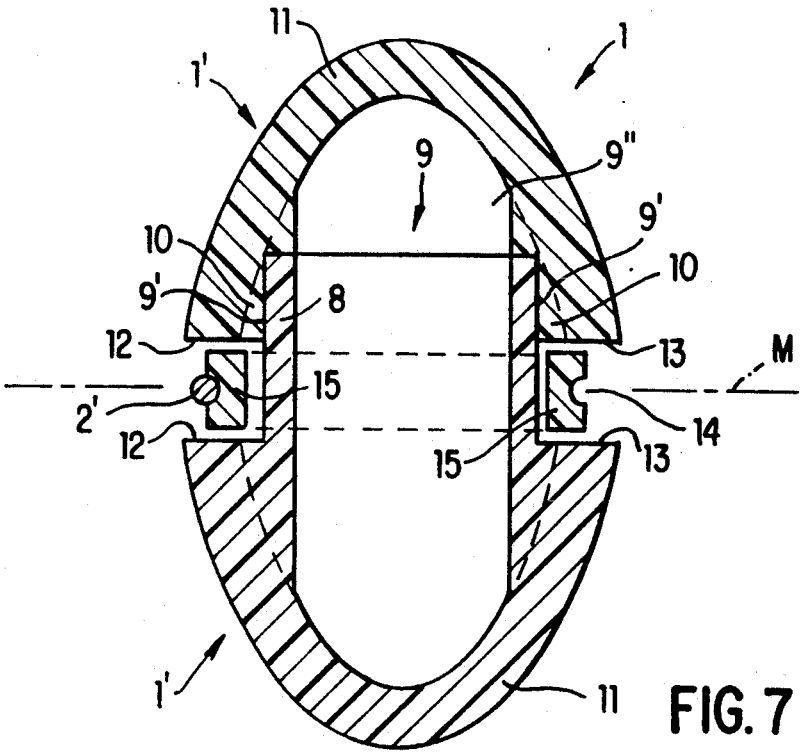
FIG. 7 shows a modified embodiment in similar representation as FIG. 5.
Figure 6:
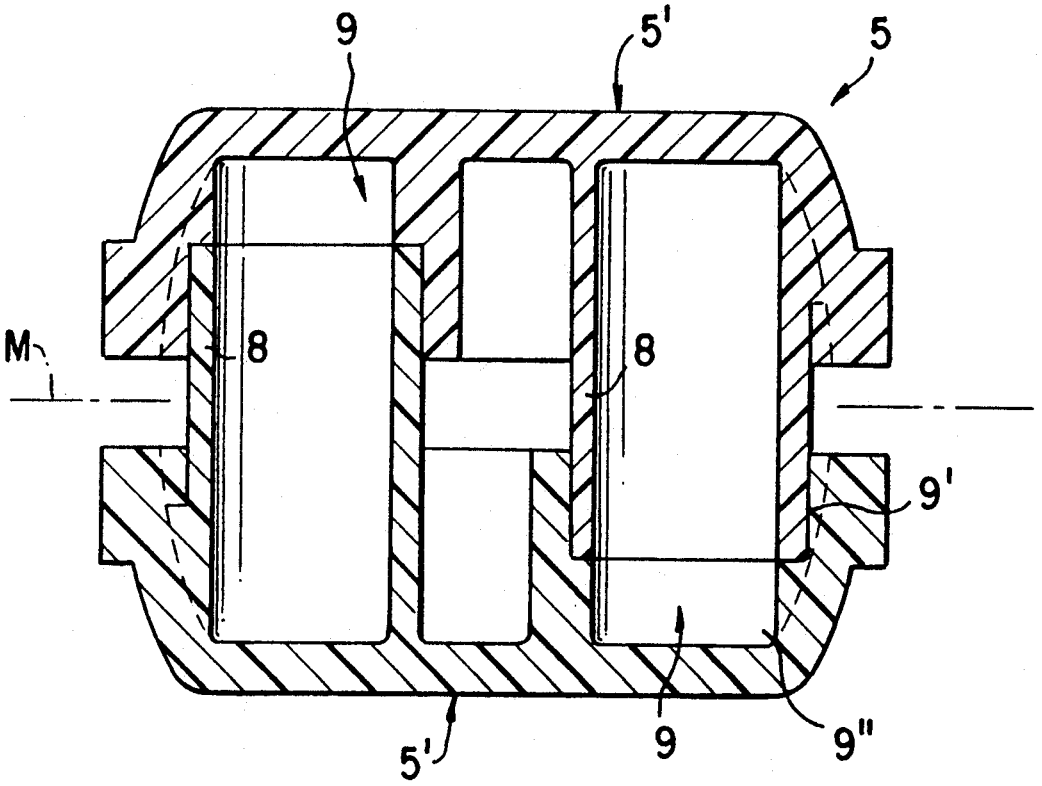
FIG. 6 shows a section corresponding to line II—II of through the handle.

Connecting pins 8 and sections 10 are formed as one piece with halves 6, 7. The connecting pins 8 and sections 10 are arranged so that each half 6 or 7 along head 1, as well as along the two throat arms 4*a*, 4*b*, has a section 10 following a connecting pin 8. Also each connecting pin 8 and each sleeve-like section 10 is provided in the area of the cross sectional center axis QM of the respective head area or throat area running vertically to center plane M (FIGS. 5 and 7). Thus, each connecting pin 8, as well as each sleeve-like projection 10, concentrically enclose this cross sectional center axis QM. Connecting pins 8 and sections 10 are provided on handle halves 5' in two rows running along the longitudinal axis L of handle 5. That is, on both sides of the longitudinal axis L. The pins and sections are arranged such that a section 10 follows a connecting pin 8, and vertical to longitudinal axis L, each section 10 is adjacent to each connecting pin 8.

Connecting pins 8 and sections 10 in the represented embodiment are each designed the same in all areas of frame halves 6, 7. For reasons of optimal stability with the smallest possible consumption of material and thus with the smallest possible weight for the tennis racket in the embodiment represented, connecting pins 8 and sections 10 on head halves 1' in those areas, where longitudinal axis L intersects these head halves 1', on throat halves 4', as well as handle halves 5,' each exhibit a greater mutual distance from one another than on the two areas of head halves 1' or head 1 lying outside relative to longitudinal axis L, where, when the tennis racket is used, especially high forces, particularly also torsion forces in head 1 and thus also between the two frame halves 6, 7 occur.

To simplify production, the two frame halves 6, 7 are designed, or formed, identical and symmetrical to longitudinal axis L. This particularly applies with regard to the arrangement or distribution of connecting pins 8 and sections 10, so that then two halves 6 and 7 produced with the same mold can be connected to one another for the frame.

The cross section profile, which head 1 or the two head halves 1' exhibit on a connecting point formed by a connecting pin 8 is shown in detail in FIG. 5. Also, the cross section profile of arms 4*a* and 4*b* of throat 4, is shown in detail in FIG. 5.

From FIG. 5 it can first be seen that the two frame halves 6, 7 or the two head halves 1' each exhibit a wall 11 forming the dish-shaped cross section profile. The two throat halves 4' in the area of arms 4*a*, 4*b* also exhibit walls 11 forming a dish-shaped profile when viewed in cross section. The dish-shaped exhibits in the cross sectional plane of FIG. 5 a curved course corresponding to a half oval or a half ellipse, so that corresponding to FIG. 5 overall dimension X in the direction of axis QM is substantially greater than dimension Y in the direction of a cross sectional axis running vertically to it and lying in center plane M. This contributes, with little weight, to the great stability of the tennis racket.

FIG. 5 further shows that connecting pins 8, which project over longitudinal sides 12 and 13 of wall 11 adjacent to center plane M, merge directly into wall 11 in the area of these longitudinal sides 12 and 13. FIG. 5 also shows that sleeve-like sections 10, which with partial section 9' of their opening 9 form the connecting opening for each to receive a connecting pin 8, are directly connected to longitudinal sides 12 and 13 of wall 11. In this way, not only is a more effective cross section possible for connecting pins 8 and the related connecting openings formed by partial areas 9', respectively, but during play the forces acting on the tennis racket are also transmitted directly to frame halves 6, 7 in the area of center plane M. Thus, the two walls 11 are fully effective for receiving these forces in their entire area. In the embodiment represented, each connecting pin 8 exhibits an outside diameter which is greater than half of dimension Y.

As can be further gathered from FIG. 5, wall 11 is reinforced in the transition area to the respective connecting pin 8 as well as in the area of sections 10. As FIG. 5 finally shows, opening 9 of each section 10 is designed so that on the open side of frame half 6 or 7, i.e., in the area of longitudinal sides 12 and 13, has partial section 9' with greater cross section serving to receive a connecting pin 8. Adjacent to partial section 9' is a partial section 9'' with a reduced cross section. Each connecting pin 8 is supported with its free end on the section formed between the two partial sections 9' and 9'' of respective opening 9. In this way, an exact engagement depth for each connecting pin 8 in related sleeve-like section 10 is established. In addition, a further reinforcement of frame halves 6 and 7 in the area of these sections 10 is achieved.

The length of connecting pins 8 is selected with the corresponding design of frame halves 6 and 7 on longitudinal sides 12 and 13 so that, with halves 6 and 7 joined together, a gap remains between halves 6 and 7 at least in the area of each connecting pin 8. That is, the longitudinal sides 12 and 13 exhibit a distance from one another. In this way it is possible to use connecting pins 8 for fastening strings 2 or stringing 3. Despite the two-piece design of the tennis racket frame, this makes possible the effective and reliable fastening of stringing 3. It also has the advantage that by utilizing an arched or curved design for connecting pins 8, at least on their peripheral areas which are wrapped around by strings 2, it is possible to provide for the fastening of stringing 3 that is easy on strings 2, and even prevents excessive abrasion of strings 2 on frame 1. By fastening strings 2 on connecting pins 8, the forces acting on stringing 3 are transmitted directly on the connecting areas between the two frame halves 6 and 7 to head 1 or the frame. Thus, this force transmission takes place where it is optimal from a static and dynamic viewpoint.

Figure 9:
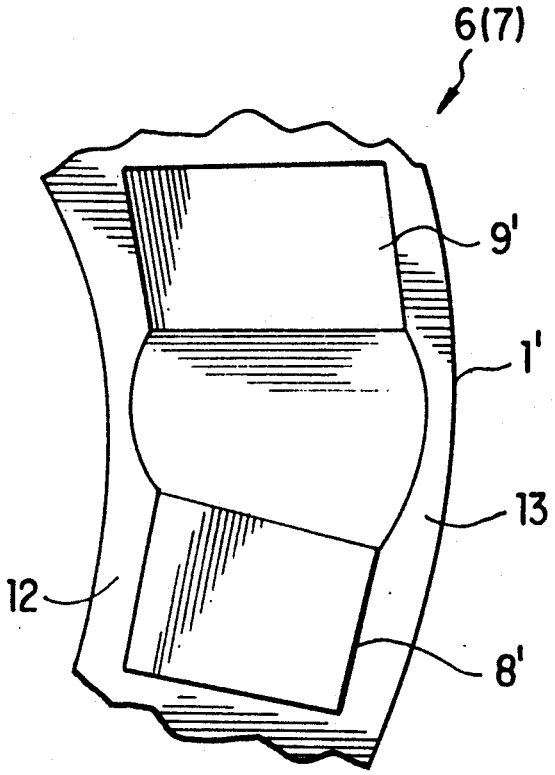
FIG. 9 shows a partial view of an alternate embodiment of the frame half shown in FIG. 3.

Frame halves 6, 7, which engage one another with their connecting pins 8 and the related sections 10, are still additionally connected to one another by appropriate measures. This may be accomplished by screws or gluing, but the preferred method is welding (ultrasound welding). Connecting pins 8 have, at least in their length engaging in respective partial section 9', a cross section deviating from the circular form. For example, connecting pins 8 have an oval or dial-shaped cross section with a peripheral area running in a straight line. Also cross section forms deviating from the circular form are conceivable in this case. In such a design, partial area 9' of each section 10 would exhibit a cross section matched to it. For example, a tetrahedral-shaped cross section as shown in FIG. 9 may be utilized. This cross section deviating from the circular form provides a connection between frame halves 6 and 7 secure from torsion and warping relative to axes QM. It is also possible to provide the cross section deviating from the circular form for connecting pins 8 and partial areas 9' of related sections 10 only at specific points of head 1, throat 4 and/or handle 5, and otherwise to provide connecting pins 8 and partial areas 9' of related sections 10 with a circular cross section. This arrangement provides special warping- and torsion-rigid connections only in specific areas and optimally adjusts the damping properties of the tennis racket.

FIG. 7 finally shows an embodiment known in the art (DE 34 -8 175 A1), in which a freely rotatable ring 15, provided with a peripheral groove 14, is placed on connecting pins 8 serving for fastening stringing 3 or on the exposed length of these connecting points 8 between frame halves 6 and 7. Then the appropriate string 2 with its length surrounding connecting pin 8 lies in this peripheral groove 14. By rings 15, produced from tough plastic, a rubbing or abrasion of strings 2 on the frame is practically completely avoided both in applying stringing 3 and in later use.

Figure 8:
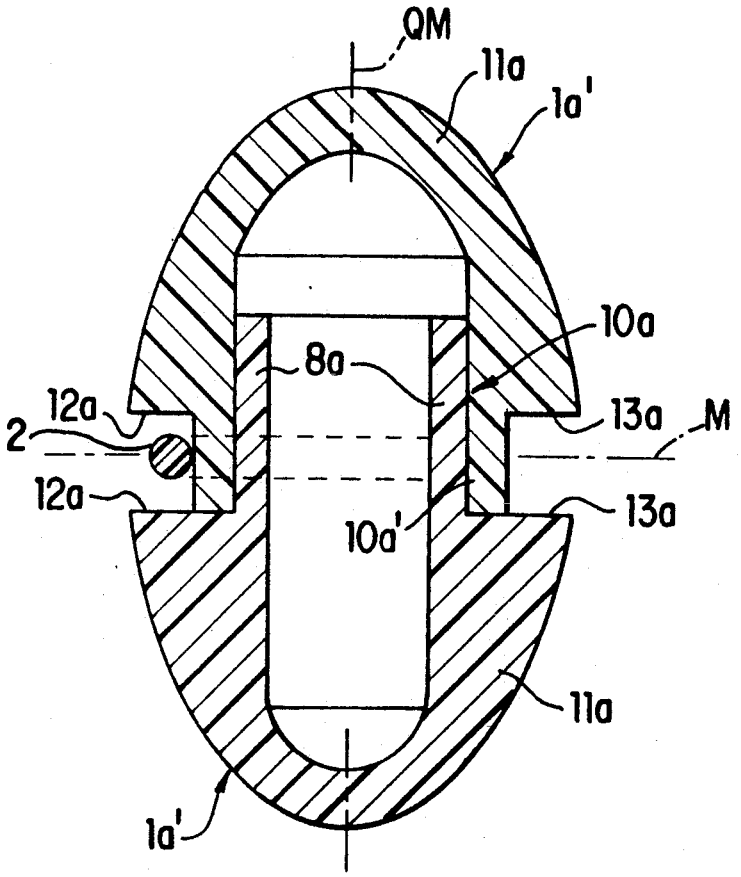
FIG. 8 shows another modified embodiment in similar representation as FIG. 5.

The ball game racket according to FIG. 8 also consists of two racket halves corresponding to halves 6 and 7, which again are designed identically. The racket halves are connected to one another by connecting pins **8*a* and related sleeve-like sections 10*a*, as shown in FIG. 8 for head halves 1a'. While connecting pins 8*a* (also designed as hollow pins in this embodiment) approximately correspond to connecting pins 8 (at most possibly exhibiting a slightly smaller outside diameter than connecting pins 8), sleeve-like sections 10*a* are designed so they project with a partial length 10*a'* in the same way that connecting pins 8*a* project over the open side —turned toward central plane M—8*a* of the trough-shaped cross section profile formed by wall 11*a* or over longitudinal sides 12*a* and 13*a*. Thus, in this embodiment connecting pins 8*a* are received each by a sleeve-like section 10*a* nearly over their entire length projecting over longitudinal sides 12*a* or 13*a*. Since the respective connection pint, formed by a connecting pin 8*a* and a related section 10*a*, exhibits a particularly large outside diameter which is determined by the outside diameter of partial length 10*a'*, especially favorable conditions result for the carrying capacity of the tennis racket. Strings 2 forming stringing 3 in this embodiment are conducted over sections 10*a* or their partial lengths 10*a'*. Both connecting pins 8*a* and sections 10*a* are again designed so that in the area of longitudinal sides 12*a* or 13*a* they merge into wall 10*a***.

Connecting pins 8 or **8*a* can also be designed slightly wedge-shaped on their outside surface, and then the related openings of sections 10 or 10*a*** have a matching cross section form.

The invention has been described above with embodiment examples. It is understood that changes and modifications are possible, without thereby leaving the basic idea of the invention.

What is claimed is:

1. A racket including:

a hollow frame comprising a handle and a head for supporting an array of strings in a central plane, the frame being formed from two frame portions disposed on opposite sides of said central plane, each said frame portion is integrally formed by plastic molding with a handle portion and a head portion, said head portion having an inwardly concave wall exhibiting two longitudinal wall edges adjacent to said central plane and facing said central plane, wherein said frame portions are identical with respect to the size and shape of the handle portions and head portions;

each said head portion having interfitting pin and sleeve connectors extending from its concave wall for engagement with complementary connectors on the other of said head portions, said pin and sleeve connectors each merging into the concave wall of each of said two longitudinal wall edges, said concave walls being spaced apart in the vicinity of at least some of said connectors to permit the strings to be strung around the connectors such that the strings are supported by the connectors, and said pins are hollow and have a diameter equal to at least half of the width of said head as measured in a direction parallel to said central plane.

2. A racket according to claim 1, wherein at least one of said connectors have a non-circular cross-section.

3. A racket according to claim 1, wherein said sleeves have an open end in the area of said central plane and said pins extend beyond said central plane into said sleeves.

4. A racket according to claim 1, wherein said sleeves and said pins extend from their respective head portion beyond said central plane.

5. A racket according to claim 1, wherein the connector interspacing varies so that the interspacing of the strings is closer near the center of the head than further away from the center.

6. A racket according to claim 1, wherein the frame portions are reinforced by carbon fibers.

7. A racket according to claim I, wherein each said head portion is symmetrical in size and shape with respect to a longitudinal axis of the handle portion, but with respect to said pin and sleeve connectors each said head portion is asymmetrical with respect to said longitudinal axis such that each pin on one side of said longitudinal axis has a corresponding sleeve on the other side of said longitudinal axis, as a result said hollow frame is formed from two frame portions which are identical with respect to the arrangement of the pin and sleeve connectors.

8. A racket including a hollow frame comprising a handle and a head for supporting an array of strings in a central plane, the frame is formed from two frame portions disposed on opposite sides of said central plane, each said frame portion is integrally formed by plastic molding with a handle portion and a head portion, said head portion having an inwardly concave wall exhibiting two longitudinal edges adjacent to said central plane and facing said central plane, wherein said frame portions are identical with respect to the size and shape of the handle portions and head portions;

each said head portion having interfitting pin and sleeve connectors extending from its concave wall for engagement with complementary connectors on the other of said head portions, said pin and sleeve connectors each merging into the concave wall at each of said two longitudinal edges, said concave walls being spaced apart in the vicinity of at least some of said connectors to permit the strings to be strung around the connectors wherein the strings are supported by the connectors, and said pins are hollow.

9. A racket according to claim 8, wherein each said head portion is symmetrical in size and shape with respect to a longitudinal axis of the handle portion, but with respect to said pin and sleeve connectors each said head portion is asymmetrical with respect to said longitudinal axis such that each pin on one side of said longitudinal axis has a corresponding sleeve on the other side of said longitudinal axis, as a result said hollow frame is formed from two frame portions which are also identical with respect to the arrangement of the pin and sleeve connectors.

10. A racket according to claim 8, wherein said pins have a diameter equal to at least half of the width of said head as measured in a direction parallel to said central plane.

11. A racket according to claim 8, wherein at least some of said connectors have a non-circular cross section.

12. A racket according to claim 8, wherein said sleeves have an open end in the area of said central plane and said pins extend beyond said central plane into said sleeves.

13. A racket according to claim 8, wherein said sleeves and said pins extend from their respective head portion beyond said central plane.

14. A racket according to claim 8, wherein the connector interspacing varies so that the interspacing of the strings is closer near the center of the head than further away from the center.

15. A racket according to claim 8 wherein the frame portions are reinforced by carbon fibers.

* * * * *